US007115006B2

(12) United States Patent
Onuma

(10) Patent No.: US 7,115,006 B2
(45) Date of Patent: Oct. 3, 2006

(54) EARTHING PLATE AND JIG FOR MOUNTING A COAXIAL CABLE THEREON

(75) Inventor: Masanori Onuma, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/341,582

(22) Filed: Jan. 30, 2006

(65) Prior Publication Data

US 2006/0189184 A1 Aug. 24, 2006

(30) Foreign Application Priority Data

Feb. 24, 2005 (JP) ..... P2005-048228

(51) Int. Cl.
*H01R 4/10* (2006.01)
*H01R 4/66* (2006.01)

(52) U.S. Cl. ..... 439/881; 29/753

(58) Field of Classification Search ..... 439/877, 439/881, 92, 855; 29/753, 761
See application file for complete search history.

(56) References Cited

U.S. PATENT DOCUMENTS 5,681,191 A * 10/1997 Robicheau et al. ..... 439/877
6,113,441 A * 9/2000 Fukase et al. ..... 439/877
6,482,034 B1 * 11/2002 Ozaki ..... 439/585

FOREIGN PATENT DOCUMENTS

JP 2004-040867 A 2/2004

* cited by examiner

*Primary Examiner*—Tho D. Ta
(74) *Attorney, Agent, or Firm*—Sughrue Mion, PLLC

(57) ABSTRACT

A braiding portion and a sheath portion of a coaxial cable are positioned at predetermined locations on a fixture plate portion by making use of a positioning line formed on the fixture plate portion as a mark corresponding to a boundary between the braiding portion and the sheath portion. In addition, the sheath portion so positioned is pressed into second clamping barrels by taper portions of a jig member which are passed through holes formed in the fixture plate portion, and in association with this, the braiding portion is also pressed into a first clamping barrel.

10 Claims, 8 Drawing Sheets

EARTHING PLATE AND JIG FOR MOUNTING A COAXIAL CABLE THEREON

BACKGROUND OF THE INVENTION

1. Field of the Invention

The present invention relates to an earthing plate and a jig for mounting a coaxial cable thereon, and more particularly to an earthing plate that is fixed to a body of an automobile or the like and a jig for mounting a coaxial cable such as an antenna cable on the earthing cable.

2. Related Art

In recent years, in many cases, a coaxial cable is connected to audio equipment installed on an automobile as an antenna cable. In order to fix the coaxial cable to the body while grounding it at an intermediate position along the length of the coaxial cable so laid out, in many cases, the coaxial cable is mounted on an electric wire fixture designated as an earthing plate. FIG. 7 is a perspective view which shows a conventional earthing plate on which a coaxial cable has not been mounted yet. FIGS. 8A and 8B are explanatory views which explain a problem inherent in the conventional earthing plate shown in FIG. 7.

As shown in FIG. 7, a conventional earthing plate 91 is formed substantially into a square conductive plate and includes two sheath portion clamping barrels 911 which extend from a front edge of the plate 91 and are turned back on themselves so as to be formed substantially into an arc-like shape and a braiding portion clamping barrel 912 which extends from the front edge at a position lying centrally between those sheath portion clamping barrels 911 and is turned back on itself so as to be formed into a U-shape. In addition, a machine screw hole 81*a* is opened at a central portion of the earthing plate 91 so that a machine screw is passed therethrough to fix the earthing plate 91 to the body.

On the other hand, a coaxial cable 92 that is to be mounted on the earthing plate 91 is made up, to describe radially outwardly from its axial center, of a core wire (not shown) which is a bundle of fine metallic wires, an insulating layer which surrounds the core wire, a braiding portion 922 provided with a layer of fine metallic wires which surrounds the insulating layer and a sheath portion 921 made of, for example, rubber which surrounds the braiding portion 922. Then, as shown in FIG. 7, the coaxial cable 92 is removed around the full circumference thereof at part of the sheath portion 921, so that the braiding portion 922 thereat is exposed.

When mounting the coaxial cable 92 so configured on the earthing plate 91, the sheath portion 921 and the braiding portion 922 are aligned, respectively, with the sheath portion clamping barrels 911 and the braiding portion clamping barrel, the respective portions of the coaxial cable 92 are then manually pressed in a direction indicated by an arrow in FIG. 7 so as to be pressed into the corresponding barrels 911, 912, and the sheath portions 921 and the braiding portion 922 are clamped by the respective barrels 911 and 912 using an exclusive jig or fastened through clamping, so that the coaxial cable 92 is fixed to the earthing plate 91.

Note that there exists JP-2004-40867A as related art document information on the aforesaid conventional earthing plate.

When the three portions, the braiding portion 922 and the two sheath portions 921, are pressed, respectively, into the barrel 912 and the two barrels 911 at the same time, however, while it is easy to press the two sheath portions 921, which are located on sides of the braiding portion 922, into the barrels 911, the centrally positioned braiding portion 922 tends to be deflected as shown in FIG. 8A.

In addition, an extent to which the sheath portion 921 and the braiding portion 922 are pressed into the barrels 911 and 912 is unclear, and due to this, in the current situations, the pressing work relies on the faculties of sensation of workers. Consequently, there sometimes occurs a case where the coaxial cable 92 is displaced in position in a direction indicated by an arrow Y in FIG. 8B.

Furthermore, since an extent to which the setting position of the coaxial cable 92 is permitted to be displaced in a direction indicated by an arrow X in FIG. 8B is also uncertain, there sometimes occurs a case where the setting position of the coaxial cable 92 is displaced in the direction indicated by the arrow X.

The deflection of the braiding portion 922 as shown in FIG. 8A and the displacement of the setting position of the coaxial cable 92 in the directions indicated by the arrows X and Y in FIG. 8B may lead to the reduction in reliability and damage to the sheath portion 921 and the braiding portion 922 by the respective barrels, and it is feared that a short-circuit will be caused in the worst case. Consequently, it is demanded that the stable product quality be secured at all times without relying on the skills and faculties of sensation of workers.

SUMMARY OF THE INVENTION

Consequently, the invention was made in view of the situations and a problem that the invention is to solve is to provide an earthing plate which enables the mounting of a coaxial cable thereon with the unchanging stable product quality without having to rely on the skills and faculties of sensation of workers and a jig for mounting a coaxial cable on the earthing plate.

With a view to solving the problem, according to a first aspect of the invention, there is provided an earthing plate comprising:

a fixture plate portion for being fixed to a mating member;

a first clamping barrel extending from an end edge of the fixture plate portion so as to securely clamp a braiding portion, which is exposed by removing a part of a sheath portion of a coaxial cable, when the braiding portion is pressed thereinto; and a second clamping barrel extending from the end edge of the fixture plate portion so as to securely clamp the sheath portion in a vicinity of the braiding portion, wherein the first clamping barrel and the second clamping barrel are clamped to hold the coaxial cable after the braiding portion and the sheath portion are pressed into the first clamping barrel and the second clamping barrel, respectively, and a hole for inserting a tapered jig member is formed on the fixture plate portion whereby the jig member is to be brought into press contact with the sheath portion to enter the sheath portion into the second clamping barrel, so that the braiding portion is pressed into the first clamping barrel.

According to the first aspect of the invention, the sheath portion, which is positioned, is pressed into the second clamping barrels by the taper portions which are passed through the holes formed in the fixture plate portion, and as a result of this, the braiding portion is also pressed into the first clamping barrel. Thus, since the holes are provided through which the taper portions of the jig member which are adapted to press the sheath portion into the second clamping barrels, it is possible to press the sheath portion into the second clamping barrels, as well as pressing the braiding portion into the braiding portion clamping barrel in an accurate manner using the jig member.

According to a second aspect of the invention, the earthing plate according to the invention may further include a positioning line formed on the fixture plate as a mark which corresponds to a boundary between the braiding portion and the sheath portion in order to accurately position the braiding portion and the sheath portion at predetermined locations on the fixture plate before the braiding portion and the sheath portion are pressed into the first clamping barrel and the second clamping barrel, respectively.

According to the second aspect of the invention, the braiding portion and the sheath portion are positioned at the predetermined locations on the fixture plate portion by making use of the positioning line formed on the fixture plate portion as the mark which corresponds to the boundary between the braiding portion and the sheath portion of the coaxial cable. Thus, the accurate longitudinal position of the coaxial cable, in particular, the accurate positioning of the braiding portion can be facilitated by making use of the positioning line. Furthermore, the deflection of the braiding portion can be suppressed to a minimum level by the accurate positioning and pressing in of the braiding portion.

According to a third aspect of the invention, in order to mount two of the coaxial cables in parallel at a predetermined interval on the fixture plate portion, it is preferable that a group of the first clamping barrel, the second clamping barrel and the hole, and another group of the first clamping barrel, the second clamping barrel and the hole are symmetrically formed on the fixture plate portion.

According to the third aspect of the invention, the group of the first clamping barrel, the second clamping barrel and the hole and the other group of the first clamping barrel, the second clamping barrel and the hole are symmetrically formed on the fixture plate portion. Consequently, the sheath portions of the two coaxial cables can be pressed, respectively, into the corresponding second clamping barrels at the same time, and the braiding portions thereof can also be pressed, respectively, into the corresponding first clamping barrels.

According to a fourth aspect of the invention that was made with a view to solving the problem, there is provided an earthing plate according to any of the first to third aspects of the invention, wherein two of the positioning lines are formed on the fixture plate so as to be substantially in parallel with the boundary, and wherein an interval between these two positioning lines is made longer than the length of the exposed braiding portion.

According to the fourth aspect of the invention, the two positioning lines are formed on the fixture plate portion so as to be substantially in parallel with the boundary, and the interval between these two positioning lines is made longer than the length of the exposed braiding portion. Consequently, the coaxial cable can be accurately positioned only by positioning the braiding portion so as to be accommodated between the two positioning lines.

According to a fifth aspect of the invention, there is provided a jig for mounting a coaxial cable on the earthing plate according to the invention, including:

a pressing jig member having a taper portion adapted to be brought into contact with the sheath portion and passed through the hole so as to gradually press the sheath portion into a deep part of the second clamping barrel when the taper portion proceeds further through the hole; and a crimping jig member adapted to be brought into contact with the first clamping barrel and the second clamping barrel so as to clamp the braiding portion and the sheath portion by gradually clamping the braiding portion and the sheath portion with the first clamping barrel and the second clamping barrel as advancing in the same direction as the taper portion.

According to the fifth aspect of the invention, the taper portions provided on the pressing jig member so as to protrude therefrom are passed through the holes in the fixture plate portion, and the sheath portion of the coaxial cable is gradually pressed into deep parts of the curled portions of the second clamping barrels by the taper portions as the passage of the taper portions through the holes proceeds further. In association with this, the braiding portion of the coaxial cable is also gradually pressed into a deep part of the curled portion of the first clamping barrel. In addition, as the crimping jig member advances in the same direction as the taper portions, the braiding portion and the sheath portion of the coaxial cable are gradually clamped by the first clamping barrel and the second clamping barrels, respectively, whereby the braiding portion and the sheath portion are clamped.

According to the first aspect of the invention, the sheath portion is pressed into the second clamping barrels by the taper portions which are passed through the holes formed in the fixture plate portion, and as a result of this, the braiding portion is also pressed into the first clamping barrel. Thus, since the holes are provided through which the taper portions of the jig member which are adapted to press the sheath portion into the second clamping barrels, it is possible to press the sheath portion into the second clamping barrels, as well as pressing the braiding portion into the first clamping barrel in an accurate manner using the jig member. Consequently, the coaxial cable can be mounted on the fixture plate portion with the stable product quality without having to rely on the skills and faculties of sensation of the workers.

According to the second aspect of the invention, the braiding portion and the sheath portion are positioned at the predetermined locations on the fixture plate portion by making use of the positioning line formed on the fixture plate portion as the mark which corresponds to the boundary between the braiding portion and the sheath portion of the coaxial cable. Thus, the accurate longitudinal position of the coaxial cable, in particular, the accurate positioning of the braiding portion can be facilitated by making use of the positioning line. Furthermore, the deflection of the braiding portion can be suppressed to a minimum level by the accurate positioning and pressing in of the braiding portion. Consequently, the coaxial cable can be mounted on the fixture plate portion with the unchanging stable product quality without having to rely on the skills and faculties of sensation of the workers.

According to the third aspect of the invention, the group of the first clamping barrel, the second clamping barrel and the hole and the other group of the first clamping barrel, the second clamping barrel and the hole are symmetrically formed on the fixture plate portion. Consequently, the sheath portions of the two coaxial cables can be pressed, respectively, into the corresponding second clamping barrels at the same time, and the braiding portions thereof can also be pressed, respectively, into the corresponding first clamping barrels. Consequently, the coaxial cable can be mounted on the fixture plate portion with the stable product quality without having to rely on the skills and faculties of sensation of the workers.

According to the fourth aspect of the invention, the two positioning lines are formed on the fixture plate portion so as to be substantially in parallel with the boundary, and the interval between these two positioning lines is made longer than the length of the exposed braiding portion. Consequently, the coaxial cable can be accurately positioned only by positioning the braiding portion so as to be accommodated between the two positioning lines. Consequently, the coaxial cable can be mounted on the fixture plate portion with the unchanging stable product quality without having to rely on the skills and faculties of sensation of the workers.

According to the fifth aspect of the invention, the taper portions provided on the pressing jig member so as to protrude therefrom are passed through the holes in the fixture plate portion, and the sheath portion of the coaxial cable is gradually pressed into deep parts of the curled portions of the second clamping barrels by the taper portions as the passage of the taper portions through the holes proceeds further. In association with this, the braiding portion of the coaxial cable is also gradually pressed into a deep part of the curled portion of the first clamping barrel. In addition, as the crimping jig member advances in the same direction as the taper portions, the braiding portion and the sheath portion of the coaxial cable are gradually clamped by the first clamping barrel and the second clamping barrels, respectively, whereby the braiding portion and the sheath portion are clamped. Consequently, the coaxial cable can be mounted on the fixture plate portion with the unchanging stable product quality without having to rely on the skills and faculties of sensation of the workers.

According to another aspect of the invention, the first clamping barrel may be formed by curling a first tongue piece extending from the end edge of the fixture plate portion.

According to another aspect of the invention, the second clamping barrel may be formed by curling a second tongue piece extending from the end edge of the fixture plate portion.

According to another aspect of the invention, the hole for inserting a tapered jig member may be located preferably between the first clamping barrel and the second clamping barrel in a longitudinal direction of the coaxial cable.

According to another aspect of the invention, it is preferable that a pair of the second clamping barrel are formed on opposite sides of the first clamping barrel in a longitudinal direction of the coaxial cable.

According to another aspect of the invention, it is preferable that a pair of holes for inserting a tapered jig member are formed on opposite sides of the first clamping barrel between the first clamping barrel and the second clamping barrels, respectively.

DETAILED DESCRIPTION OF THE PREFERRED EMBODIMENTS

Hereinafter, an embodiment of the invention will be described based on the drawings.

Figure 1:
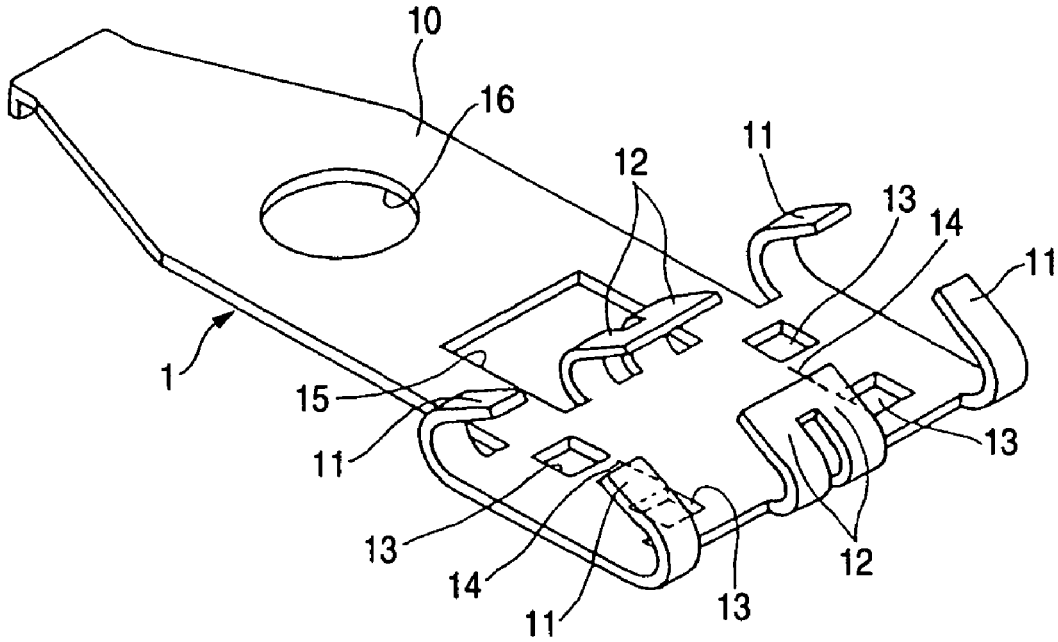
FIG. 1 is a perspective view which shows an earthing plate according to an embodiment of the invention.
Figure 2:
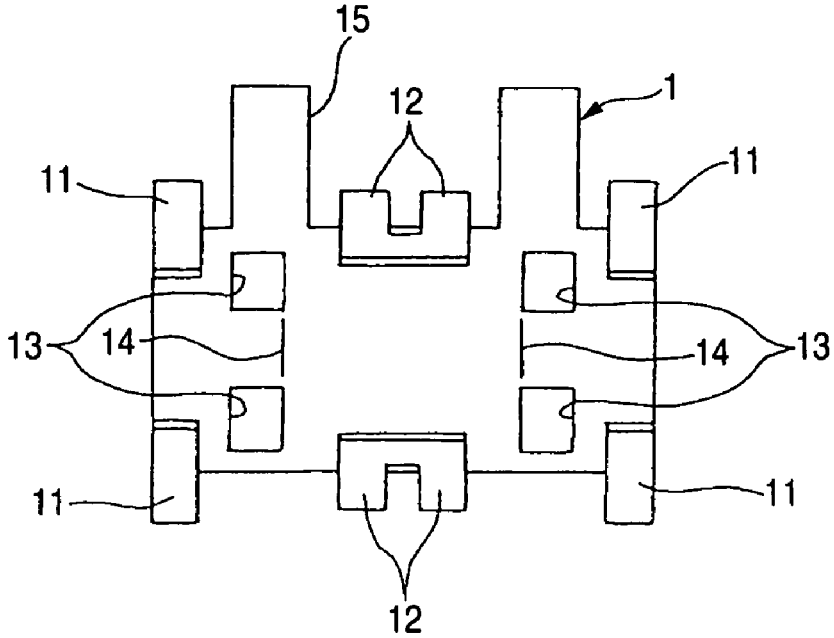
FIG. 2 is a top plan view of a main part of the earthing plate in FIG. 1.
Figure 3:
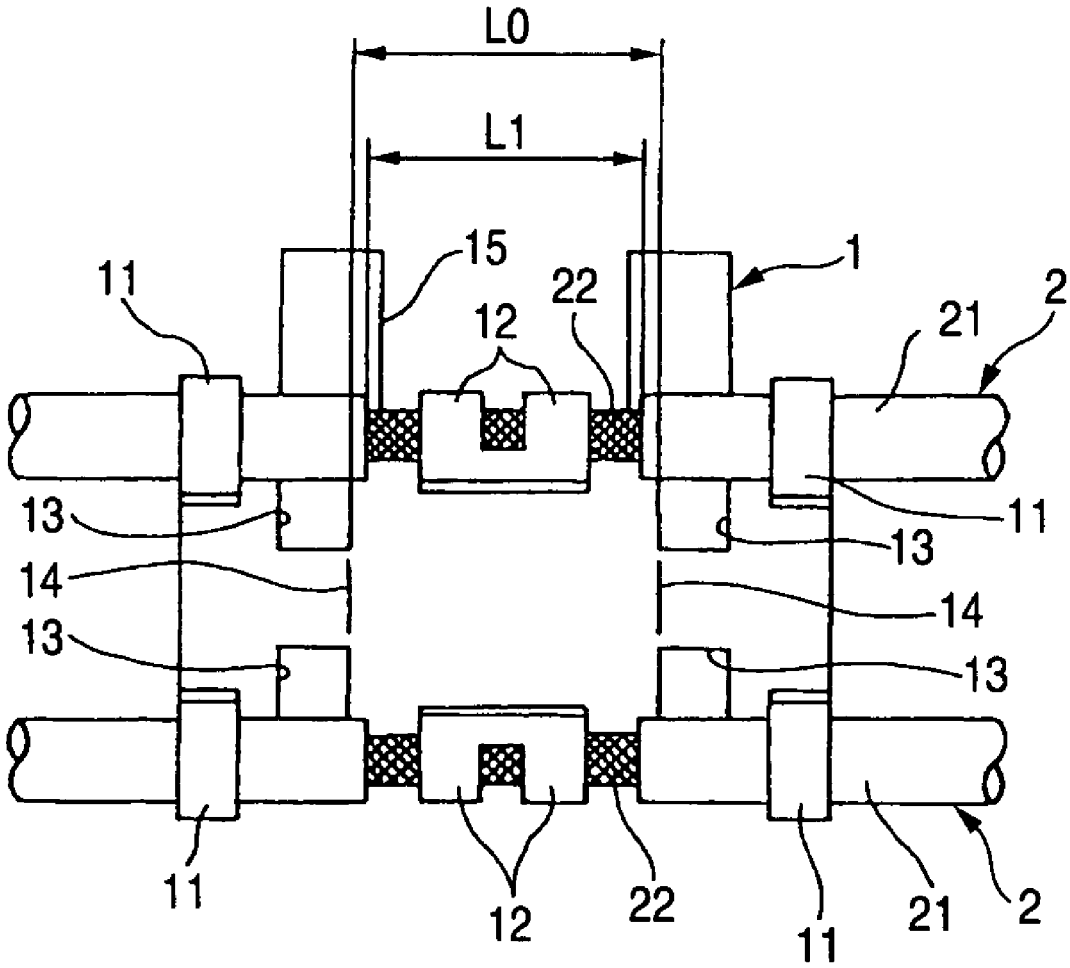
FIG. 3 is a top plan view of the main part of the earthing plate in FIG. 2.

Firstly, using FIGS. 1 to 3, an earthing plate of an embodiment of the invention will be described. FIG. 1 is a perspective view which shows an earthing plate of an embodiment of the invention. FIG. 2 is a top plan view of a main part of the earthing plate shown in FIG. 1. FIG. 3 is a top plan view of the earthing plate shown in FIG. 2 with coaxial cables set thereon.

An earthing plate 1 of the embodiment of the invention shown in FIGS. 1 to 3 is a metallic fixture for fixing coaxial cables 2 to audio equipment installed, for example, on an automobile as antenna cables to a body of the automobile while grounding them at intermediate locations along the lengths of the coaxial cables 2 so laid out. The earthing plate 1 is made of a sheet metal having superior conductivity and is eventually formed into a shape shown in FIGS. 1 to 3 through pressing and bending processes.

As shown in FIGS. 1 to 3, the earthing plate 1 is basically configured so as to have a fixture plate portion 10, braiding portion clamping barrels (first clamping barrels) 12 and sheath portion clamping barrels (second clamping barrel) 11. In particular, this earthing plate 1 is such as to cope with two coaxial cables 2, and a group of the braiding portion clamping barrel 12 and the two sheath portion clamping barrels 11 and another similar group of the braiding portion clamping barrel 12 and the two sheath portion clamping barrels 11 are symmetrically formed. In addition, after the braiding portions 22 and the sheath portions 21 of the two coaxial cables 2 are pressed, respectively, into the corresponding braiding portion clamping barrels 12 and the sheath portion clamping barrels 11, the braiding portion clamping barrels 12 and the sheath portion clamping barrels 11 are crimped so as to hole the two coaxial cables 2.

The fixture plate portion 10 is a flat portion where the earthing plate 1 is fixed to a mating member and has a circular machine screw hole 16 through which a machine screw (not shown) is passed through to fix the earthing plate 1 to the mating member and four quadrangular holes 13 through which taper portions of a jig, which will be described later on, are passed through. Note that a quadrangular hole 15 possessed by the fixture plate portion 10 are formed as a result of the formation of the braiding portion clamping barrel 12. A pair of the sheath portion clamping barrels 11 are formed on opposite sides of the braiding portion clamping barrel 12 in a longitudinal direction of the coaxial cable 2. A pair of holes 13 for inserting the tapered portions of the jig are formed on opposite sides of the braiding portion clamping barrel 12 so as to be located between the braiding portion clamping barrel 12 and the pair of the sheath portion clamping barrels 11, respectively.

Additionally, two positioning lines 14 are stamped on the fixture plate portion 10. The positioning lines 14 are such as to accurately position the braiding portions 22 and the sheath portions 21 of the coaxial cables 2 at predetermined locations on the fixture plate portion 10 before the braiding portions 22 and the sheath portions 21 are pressed into the corresponding the braiding portion clamping barrels 12 and the sheath portion clamping barrels 11 and are stamped as marks which correspond to boundaries between the braiding portion 22 and the sheath portion 21. To describe specifically, those two positioning lines 14 are stamped on the fixture plate portion 10 so as to be in parallel with the boundaries between the braiding portion 22 and the sheath portion 21. Then, as shown in FIG. 3, an interval L0 between the two positioning lines is made longer than an exposed length L1 of the braiding portion 22, whereby the coaxial cables 2 can accurately be positioned only by aligning the coaxial cables 2 so as to be accommodated between the two positioning lines 14. Note that the positioning lines 14 may be formed not only by stamping but also by other methods such as printing.

The sheath portion clamping barrels 11 are portions where the sheath portions 21 of the coaxial cable 2, which lie on both sides of the exposed braiding portion 22, are pressed to thereby be clamped. The sheath portion clamping barrels 11 are formed by curling a pair of tongue pieces extending from an end edge of the fixture plate portion 10 at positions corresponding to the sides of the braiding portion clamping barrel 12 to be turned back on themselves to thereby be formed into a U-shape.

The braiding portion clamping barrel 12 is a portion where the braiding portion 22, which is exposed by removing the sheath portion 21 at the relevant portion of the coaxial cable 2, is pressed to thereby be clamped. The braiding portion clamping barrel 12 is formed by curling a tongue piece extending from the end edge of the fixture plate portion 10 as a position corresponding to a central portion of the pair of sheath portion clamping barrels 11 to be turned back on itself so as to be formed into a U-shape. Note that while the braiding portion clamping barrel 12 is longer in longitudinal length than the sheath portion clamping barrel 11, in order to facilitate the clamping thereof, a slit is provided at a central portion thereof.

Additionally, the coaxial cable 2, which is to be mounted on the earthing plate 1, is made up, to describe radially outwardly from its axial center, of a core wire (not shown) which is a bundle of fine metallic wires, an insulating layer which surrounds the core wire, the braiding portion 22 provided with a layer of fine metallic wires which surrounds the insulating layer and the sheath portion 21 made of, for example, rubber which surrounds the braiding portion 22. Then, as shown in FIG. 3, the coaxial cable 2 is removed around the full circumference thereof at part of the sheath portion 21, so that the braiding portion 22 thereat is exposed.

Figure 4:
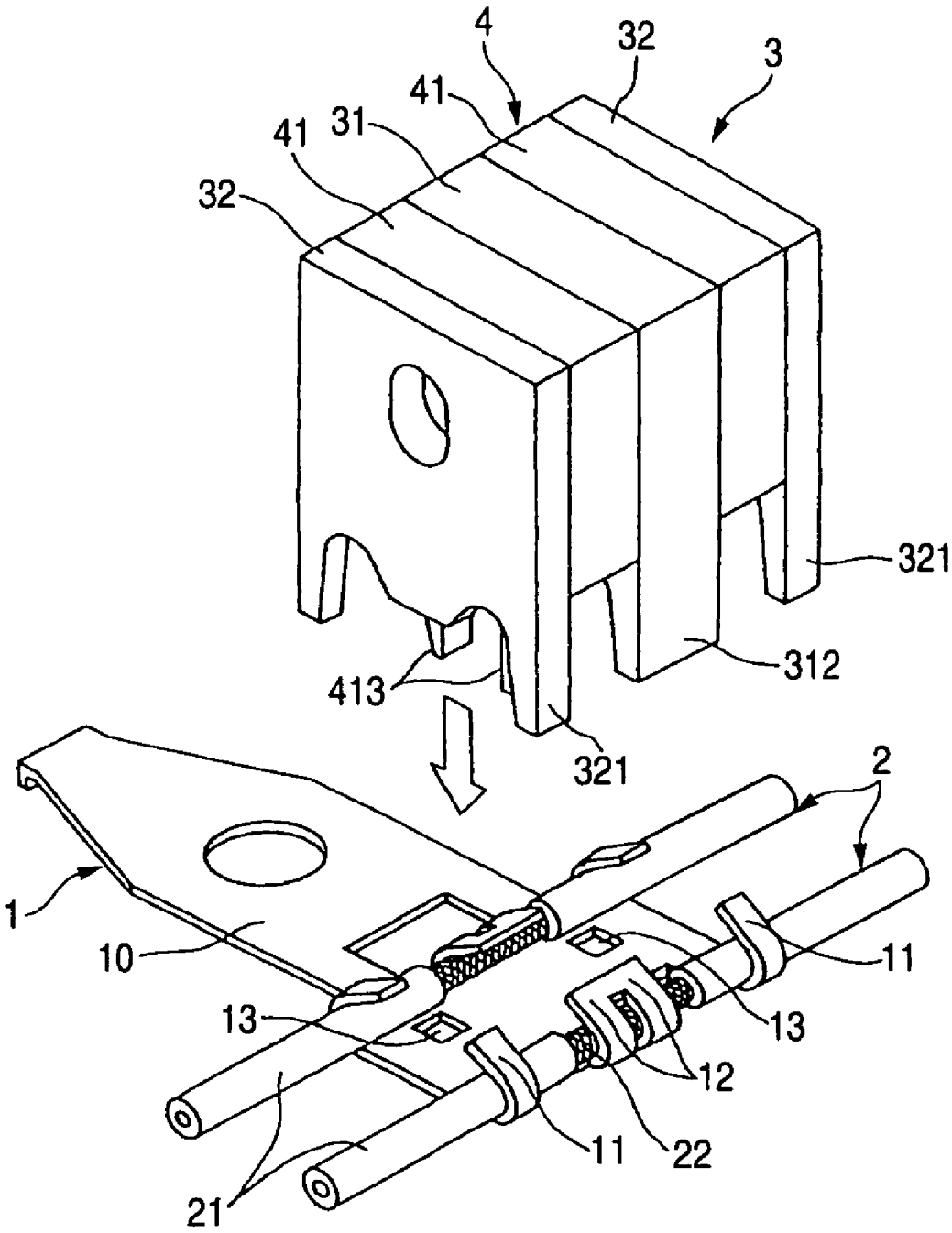
FIG. 4 is a perspective view which shows a jig according to the embodiment of the invention.
Figure 5A:
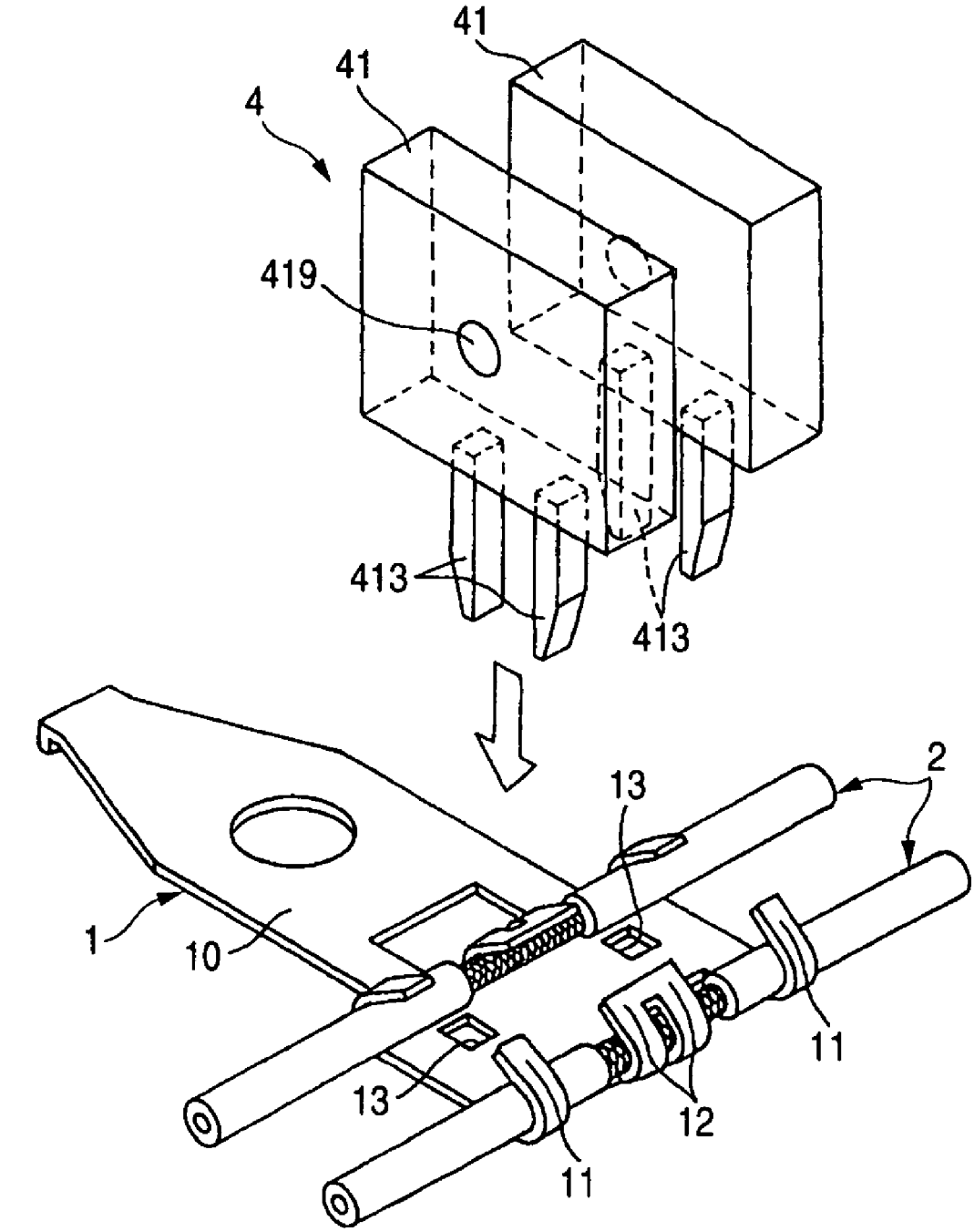
FIGS. 5A and 5B are perspective views which show, respectively, a pressing jig member and a crimping jig member of the jig shown in FIG. 4.
Figure 5B:
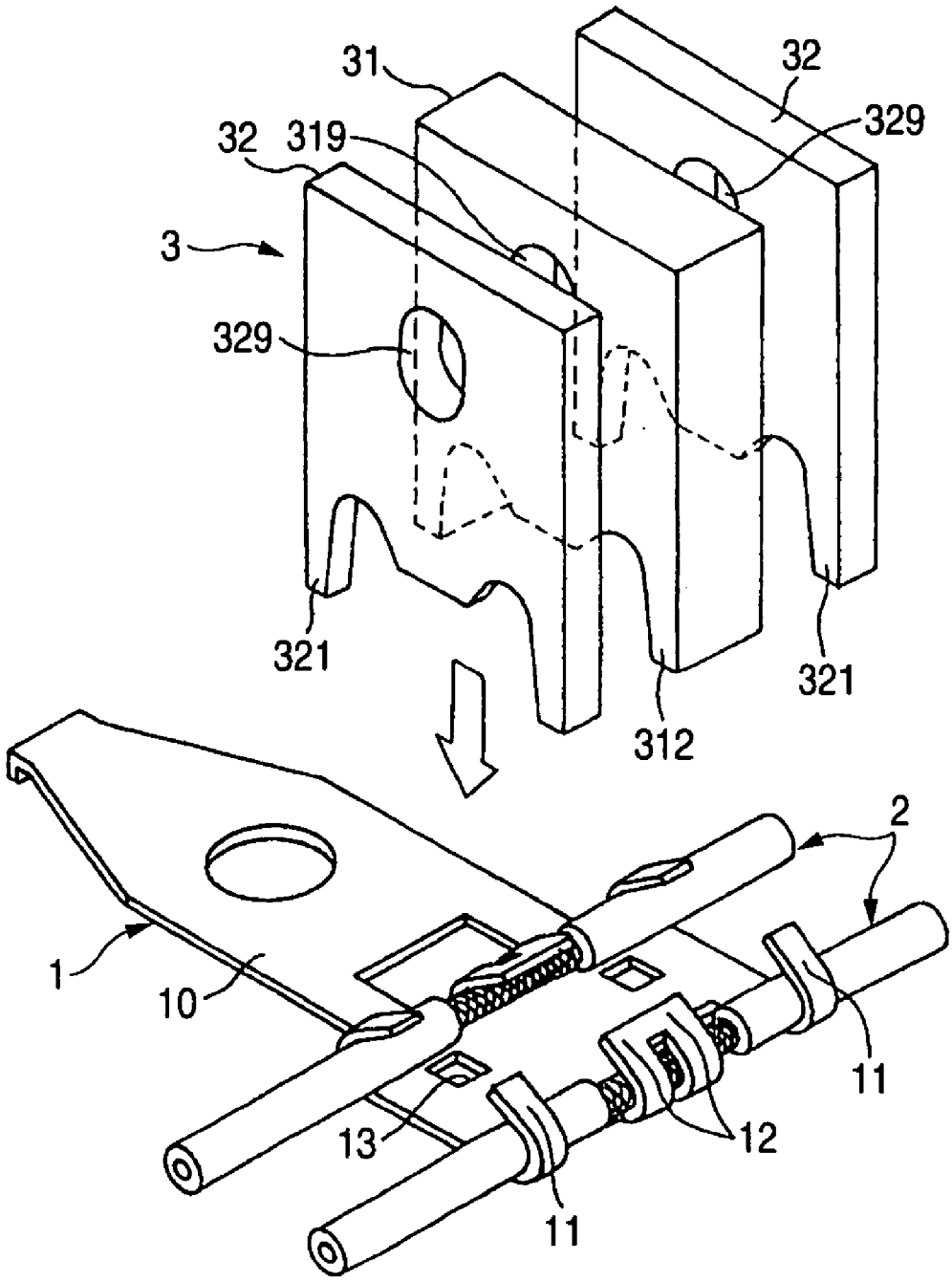

Next, using FIGS. 4, 5A and 5B, a jig for mounting the coaxial cables 2 on the earthing plate 1 will be described. FIG. 4 is a perspective view which shows a jig according to the embodiment of the invention. FIGS. 5A and 5B are perspective views which show, respectively, a pressing jig member and a crimping jig member of the jig shown in FIG. 4.

As shown in FIG. 4, a jig according to the embodiment is provided with a pressing jig member 4 and a crimping jig member 3 which are integrated thereinto. The pressing jig member 4 is, as shown in FIG. 5A, provided with two pressing jig members 41, 41 which are formed into the same shape, and the pressing jig members 41, 41 each have legs 413 which are provided on a base portion of a rectangular parallelepiped so as to project therefrom to form a U-shape together. Taper portions 413*a* (refer to FIGS. 6A, 6B and 6C) are formed on outside portions of the U-shape forming leg portions 413 so as to be brought into contact with the coaxial cables 2. The taper portions 413*a* are formed so as to facilitate the pressing of the coaxial cables 2 into deep parts of curled portions of the respective barrels as the U-shape forming leg portions 413 advance in a direction indicated an arrow in FIG. 5A. A circular shaft hole 419 is also formed in the base portion. Since two of the pressing jig members 41 are included in the jig of the embodiment, the jig is to have four taper portions 413*a*.

On the other hand, the crimping jig member 3 is, as shown in FIG. 5B, provided with a crimping jig member 31 which corresponds to the braiding portion clamping barrels 12 and two crimping jig members 32 which correspond, respectively, to the sheath portion clamping barrels 11 which lie on both sides of the braiding portion clamping barrels 12. The crimping jig member 31 has two leg portions 312 which are provided on a base portion of a rectangular parallelepiped in which an elliptic shaft hole 319 is formed so as to project therefrom. The two crimping jig members 32 are formed into the same shape and each have two leg portions 321 which are provided on a base portion of a rectangular parallelepiped in which an elliptic shaft hole 329 is formed so as to project therefrom. The leg portions 312 and the leg portions 321 are each curved on an inside thereof in order to facilitate the clamping of the braiding portion clamping barrels 12 and the sheath portion clamping barrels 11 as the leg portions 312 and the leg portions 321 advance in a direction indicated by an arrow in FIG. 5B.

Figure 8A:
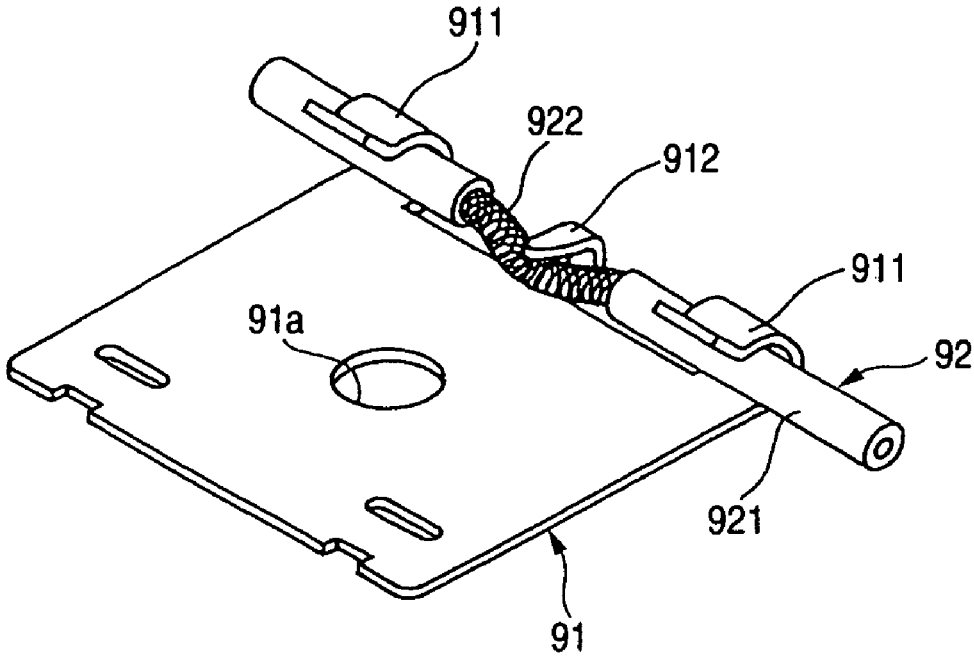
FIGS. 8A and 8B are explanatory views which explain a problem inherent in the conventional earthing plate shown in FIG. 7.
Figure 8B:
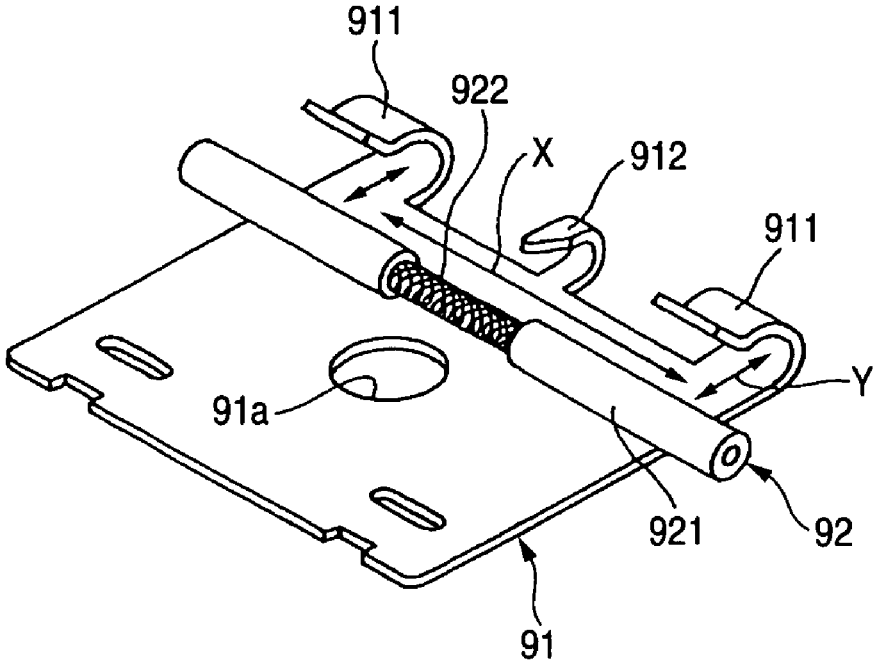

The pressing jig members 41 and the crimping jig members 31, 32, which are configured as described above, are integrated together so as to make up the jig for mounting the coaxial cables 2 on the earthing plate 1. To describe specifically, as shown in FIG. 4, the crimping jig member 31 is disposed centrally, and the other two crimping jig members 32 are disposed so that each of the two pressing jig members 41 is held between the centrally disposed crimping jig member 31 and themselves, whereby the single jig is constructed. The crimping jig members 31 and 32 are disposed so as to correspond to the braiding portion clamping barrels 12 and the sheath portion clamping barrels 11. In addition, when the jig is displaced in the direction indicated by the arrow in FIG. 4, the coaxial cables 2 are clamped simultaneously by the respective barrels 11, 12 while transverse (the direction Y in FIG. 8B) positional deviations of the coaxial cables 2 are corrected.

Figure 6A:
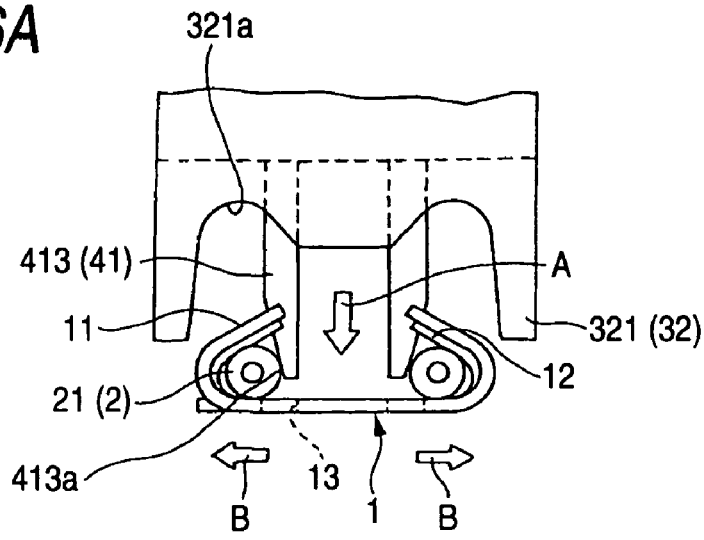
FIGS. 6A to 6C are explanatory views which explain the function of the jig of the embodiment of the invention when mounting coaxial cables on the earthing plate.
Figure 6B:
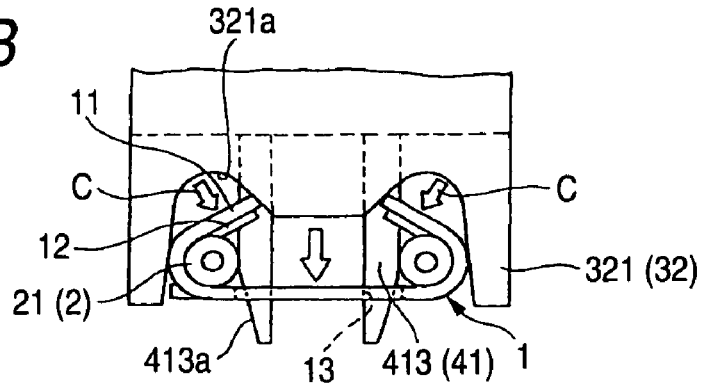
Figure 6C:
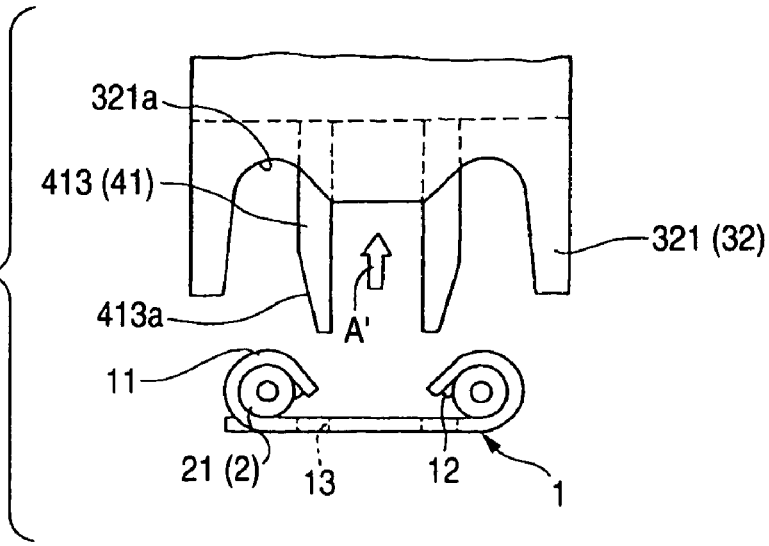
Figure 7:
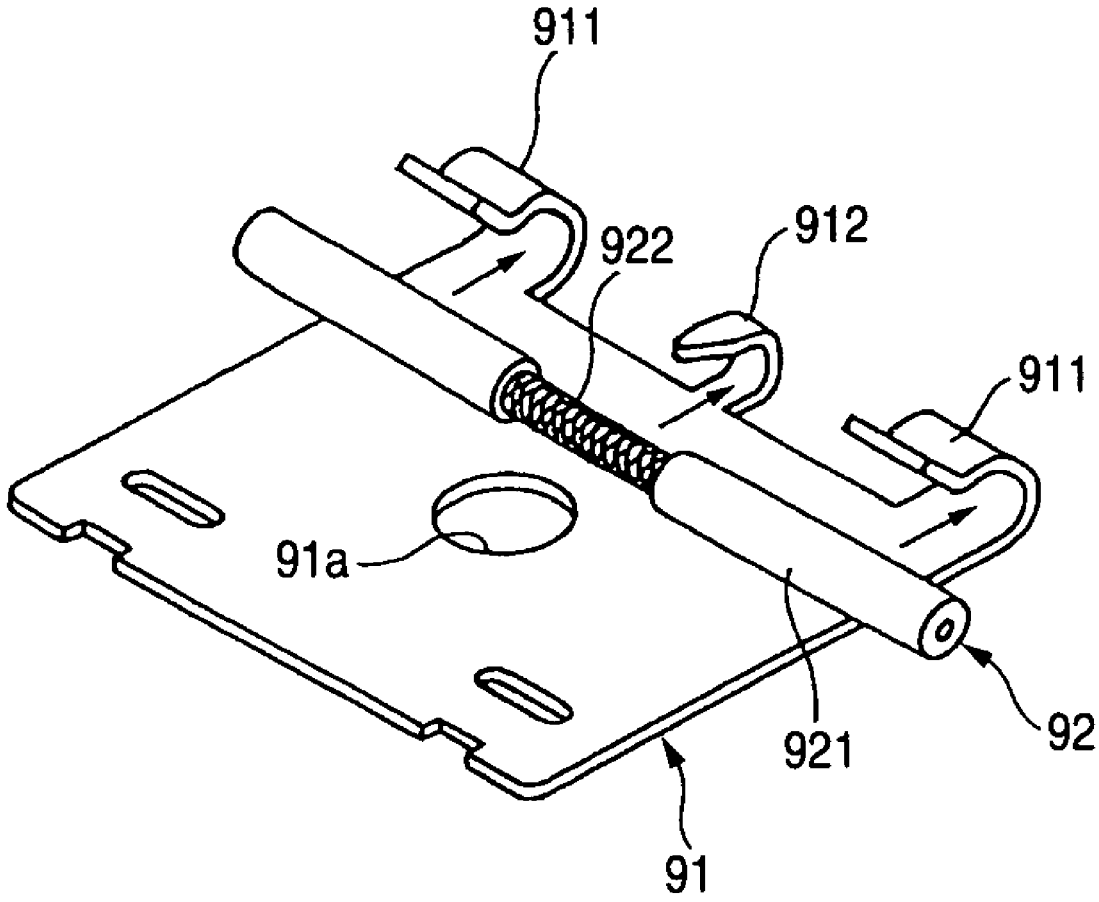
FIG. 7 is a perspective view which shows a conventional earthing plate.

Next, additionally referring to FIGS. 6A to 6C, the function of the aforesaid positional deviation correction and clamping of the coaxial cables will be described below. FIGS. 6A to 6C are explanatory views which explain the function of the jig according to the embodiment of the invention when the coaxial cables are mounted.

Before the jig is used, firstly, as shown in FIG. 3, the coaxial cables 2 are disposed on the earthing plate 1 so that the braiding portions 22 thereof are accommodated between the two positioning lines 14.

Next, as shown in FIG. 6A, with the pressing jig members 41 and the crimping jig members 31, 32 integrated together, the U-shape forming leg portions 413 of the pressing jig members 41 are inserted into the holes 13 in the earthing plate 1, and the jig is lowered in a direction indicated by an arrow A in the figure. Then, the taper portions 413*a* of the pressing jig members 41 catch the sheath portions 21 of the coaxial cables 2, whereby the sheath portions 21 are pressed out in directions indicated by arrows B in the same figure. As a result, the sheath portions 21 are pressed into the deep parts of the curled portions of the sheath portion clamping barrels 11, and in association with this, the braiding portions 22 are also pressed into the deep parts of the curled portions of the braiding portion clamping barrels 12. Namely, as shown in FIG. 6B, the whole coaxial cables 2 are pressed into the respective barrels 11, 12. As this occurs, the U-shape forming leg portions 413 of the pressing jig members 41 have passed through the holes 13, whereby the transverse (the direction Y in FIG. 8B) positional deviations of the coaxial cables 2 are automatically and accurately corrected.

Next, as shown in FIG. 6B, with the state maintained in which the U-shape forming leg portions 413 are in contact with the coaxial cables 2, whereby the coaxial cables 2 are corrected in position, the crimping jig members 32 (31) are lowered in the direction indicated by the arrow A in the figure, so that the respective leg portions 321 (312) of the crimping jig members 32 (31) are brought into contact with the sheath portion clamping barrels 11 and the braiding portion clamping barrels 12, whereby the sheath portion clamping barrels 11 and the braiding portion clamping barrels 12 are crimped at the same time, the coaxial cables 2 being thereby clamped.

Then, as shown in FIG. 6C, the pressing jig members 41 and the crimping jig members 32 (31) are raised in a direction indicated by an arrow A' in the figure, whereupon a stroke of motion of the jig completes. The transverse positional deviations of the coaxial cables 2 are accurately corrected at all times by the stoke of motion of the jig without having to rely on the faculty of sensation of the worker, and the clamping of the respective barrels 11, 12 is implemented at the same time.

Note that while the two coaxial cables 2 are described as being clamped in the embodiment, only a single coaxial cable 2 may be clamped on the earthing plate 1. In this case, the blank barrels disposed on the side where no coaxial cable 2 is allocated may only have to be so crimped with no coaxial cable held therein.

As has been described heretofore, according to the embodiment of the invention, the braiding portions 22 and the sheath portions 21 of the coaxial cables 2 are positioned at the predetermined locations on the fixture plate by making use of the positioning lines 14 formed on the fixture plate portion 10. Then, the sheath portions 21 are pressed into the sheath portion clamping barrels 11 by the taper portions 413*a* of the jig members which are passed through the holes 13 formed in the fixture plate portion 10, and in association with this, the braiding portions 22 are also pressed into the braiding portion clamping barrels 12. At the same time, the braiding portions 22 and the sheath portions 21 of the coaxial cables 2 are gradually clamped by the respective barrels, and eventually, the braiding portions 22 and the sheath portions 21 are clamped to the earthing plate 1. In addition, in association with the accurate positioning and pressing, the deflection of the braiding portions 22 can be suppressed to a minimum level. Consequently, the coaxial cables 2 can be mounted on the fixture plate portion 10 with the unchanging stable product quality, without having to rely on the skills and faculties of sensation of the workers. In association with this, it is possible to avoid the trapping of the sheath portion 21 by the barrel due to the longitudinal positional deviation of the coaxial cable 2 and the ripping of the sheath portion 21 by the distal end of the barrel at the time of clamping due to the transverse positional deviation of the coaxial cable 2, thereby making it possible to avoid a short-circuit with an internal conductor.

Note that while the earthing plate of the embodiment is such as to cope with the two coaxial cables 2, the earthing plate can easily be altered to an earthing plate which copes with a single coaxial cable 2. In addition, while the taper portions and the holes through which the taper portions are passed are quadrangular in the embodiment, other shapes, for example, a triangular shape can be adopted instead. The invention includes these slightly altered forms.

What is claimed is:

1. An earthing plate comprising:

a fixture plate portion for being fixed to a mating member;

a first clamping barrel extending from an end edge of the fixture plate portion so as to securely clamp a braiding portion, which is exposed by removing a part of a sheath portion of a coaxial cable, when the braiding portion is pressed thereinto; and a second clamping barrel extending from the end edge of the fixture plate portion so as to securely clamp the sheath portion in a vicinity of the braiding portion, wherein the first clamping barrel and the second clamping barrel are clamped to hold the coaxial cable after the braiding portion and the sheath portion are pressed into the first clamping barrel and the second clamping barrel, respectively, and a hole for inserting a tapered jig member is formed on the fixture plate portion whereby the jig member is to be brought into press contact with the sheath portion to enter the sheath portion into the second clamping barrel, so that the braiding portion is pressed into the first clamping barrel.

2. An earthing plate according to claim 1, wherein the first clamping barrel is formed by curling a first tongue piece extending from the end edge of the fixture plate portion.

3. An earthing plate according to claim 1, wherein the second clamping barrel is formed by curling a second tongue piece extending from the end edge of the fixture plate portion.

4. An earthing plate according to claim 1, wherein the hole for inserting a tapered jig member is located between the first clamping barrel and the second clamping barrel in a longitudinal direction of the coaxial cable.

5. An earthing plate according to claim 1, wherein in order to mount two of the coaxial cables in parallel at a predetermined interval on the fixture plate portion, a pair of the first clamping barrels, the second clamping barrel and the holes are symmetrically formed on the fixture plate portion.

6. A jig for mounting a coaxial cable on the earthing plate according to claim 1, comprising:

a pressing jig member having a taper portion adapted to be brought into contact with the sheath portion and passed through the hole so as to gradually press the sheath portion into a deep part of the second clamping barrel when the taper portion proceeds further through the hole; and a crimping jig member adapted to be brought into contact with the first clamping barrel and the second clamping barrel so as to clamp the braiding portion and the sheath portion by gradually clamping the braiding portion and the sheath portion with the first clamping barrel and the second clamping barrel as advancing in the same direction as the taper portion.

7. An earthing plate according to claim 1, wherein a pair of the second clamping barrel are formed on opposite sides of the first clamping barrel in a longitudinal direction of the coaxial cable.

8. An earthing plate according to claim 7, wherein a pair of holes for inserting a tapered jig member are formed on opposite sides of the first clamping barrel between the first clamping barrel and the second clamping barrels, respectively.

9. An earthing plate according to claim 1, further comprising a positioning line formed on the fixture plate as a mark which corresponds to a boundary between the braiding portion and the sheath portion in order to accurately position the braiding portion and the sheath portion at predetermined locations on the fixture plate before the braiding portion and the sheath portion are pressed into the first clamping barrel and the second clamping barrel, respectively.

10. An earthing plate according to claim 9, wherein two of the positioning lines are formed on the fixture plate so as to be substantially in parallel with the boundary, and an interval between these two positioning lines is made longer than the length of the exposed braiding portion.

* * * * *